US006270060B1

(12) United States Patent
Yost

(10) Patent No.: US 6,270,060 B1
(45) Date of Patent: Aug. 7, 2001

(54) SLIDE CARBURETOR WITH ADJUSTABLE VENT HOLE IN SLIDE

(76) Inventor: Robert M. Yost, 10838 Olive St. NW., Coon Rapids, MN (US) 55448

( * ) Notice: Subject to any disclaimer, the term of this patent is extended or adjusted under 35 U.S.C. 154(b) by 0 days.

(21) Appl. No.: 09/303,841

(22) Filed: May 3, 1999

(51) Int. Cl.[7] ..... F02M 9/06
(52) U.S. Cl. ..... 261/44.3; 261/DIG. 38
(58) Field of Search ..... 261/44.3, 44.4, 261/DIG. 38

(56) References Cited

U.S. PATENT DOCUMENTS

| | | | | |
|---|---|---|---|---|
| 1,822,712 | * | 9/1931 | Skinner | 261/44.4 |
| 3,243,167 | * | 3/1966 | Winkler | 261/44.4 |
| 3,333,832 | * | 8/1967 | O'Neill | 261/44.4 X |
| 3,424,441 | * | 1/1969 | Caisley et al. | 261/44.4 |
| 4,079,713 | * | 3/1978 | Laprade et al. | 261/44.4 X |
| 4,136,139 | * | 1/1979 | Nakamura et al. | 261/44.4 |
| 4,302,405 | * | 11/1981 | Inoue et al. | 261/44.4 |
| 4,508,664 | * | 4/1985 | Tamura et al. | 261/44.4 |
| 5,562,868 | * | 10/1996 | Yost | 261/44.3 X |
| 5,662,836 | * | 9/1997 | Yost | 261/DIG. 38 |

FOREIGN PATENT DOCUMENTS

| | | | | |
|---|---|---|---|---|
| 54-50727 | * | 4/1979 | (JP) | 261/44.4 |
| 58-170841 | * | 10/1983 | (JP) | 261/44.4 |
| 59-25066 | * | 2/1984 | (JP) | 261/44.4 |
| 60-138262 | * | 7/1985 | (JP) | 261/44.4 |
| 2-123270 | * | 5/1990 | (JP) | 261/44.4 |

* cited by examiner

*Primary Examiner*—Richard L. Chiesa
(74) *Attorney, Agent, or Firm*—James W. Miller

(57) ABSTRACT

A carburetor includes a fuel jet having a reciprocal needle received therein for controlling fuel as such fuel flows into an air flow passage of the carburetor. The needle is carried by a reciprocal slide which includes a vent hole in the bottom surface thereof. A rotatable valve plate is carried inside the slide overlying the vent hole. The valve plate is movable between various adjusted positions for changing the size of the vent hole.

7 Claims, 3 Drawing Sheets

SLIDE CARBURETOR WITH ADJUSTABLE VENT HOLE IN SLIDE

TECHNICAL FIELD

This invention relates to a carburetor for supplying fuel to an air flow passage where such fuel is mixed with air to form an air/fuel mixture prior to such mixture being admitted to a combustion chamber of an internal combustion engine. More particularly, this invention relates to a slide carburetor having a vent hole in the slide.

BACKGROUND OF THE INVENTION

Carburetors are known for supplying fuel to an air flow passage of a carburetor or similar device where such fuel is mixed with air to form a combustible air/fuel mixture. Such carburetors have one or more fuel jets which are usually located in a venturi portion of the air flow passage, upstream of the throttle plate, such that the vacuum produced in the venturi portion helps draw fuel through the jet and into the air flow passage. Some carburetors may have multiple jets located in the air flow passage. For example, a slow jet may be provided for supplying fuel at idle or at low speeds and a main jet may be provided for supplying fuel at midrange or high speeds.

The main fuel jets used in such carburetors often have a flow controlling needle that is reciprocally contained within the fuel flow passage of the fuel jet. The amount of fuel delivered by the fuel jet is controlled by sliding the needle into or out of the fuel jet using a reciprocal slide that is mounted in the carburetor body. The upper end of the needle is connected to the slide such that vertical up and down movement of the slide is translated into vertical up and down movement of the needle. The needle includes a tapered section which creates a bigger gap between the outer diameter of the needle and the fuel flow passage of the fuel jet as the needle rises, thus increasing the fuel flow through the main jet as the needle rises in the main jet.

A vent hole is typically provided in the slide on the bottom of the slide. The Applicant has discovered that varying the size of the vent hole affects how quickly the slide moves up and down and, thus, affects the engine performance. However, in known slide carburetors, there is no way to easily and quickly adjust the size of the vent hole.

SUMMARY OF THE INVENTION

One aspect of this invention relates to a slide carburetor with a vent hole and, more particularly, to a valve that is movably carried on the slide to adjust the size of the vent hole.

These and other aspects of this invention are provided by a slide carburetor which comprises a reciprocal slide that moves up and down in an air flow passage. Movement of the slide controls the amount of fuel supplied to the air flow passage for mixing with air. A vent hole on the slide has an adjustable size to adjust the rate of movement of the slide.

Another aspect of this invention is provided in an air/fuel mixing device which comprises a fuel jet for supplying fuel to an air flow passage. The fuel jet has a fuel flow passage that is operatively connected to the air flow passage for conducting fuel from a supply of fuel through the fuel jet and into the air flow passage. A flow controlling needle is reciprocally mounted by a slide in the fuel flow passage of the fuel jet to control the amount of fuel that flows therein. A vent hole is located on the slide. A valve is movably carried on the slide to adjust the size of the vent hole.

A final aspect of this invention relates to a carburetor which comprises a fuel jet having a reciprocal needle received therein for controlling fuel as the fuel flows into an air flow passage of the carburetor. A reciprocal slide is provided which includes a vent hole in a bottom surface of a hollow chamber located within the slide, wherein the needle is carried on the slide. A rotatable valve plate is carried inside the chamber in the slide such that the valve plate overlies the vent hole, wherein the valve plate is movable between various adjusted positions relative to the slide for changing the size of the vent hole.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Figure 1:
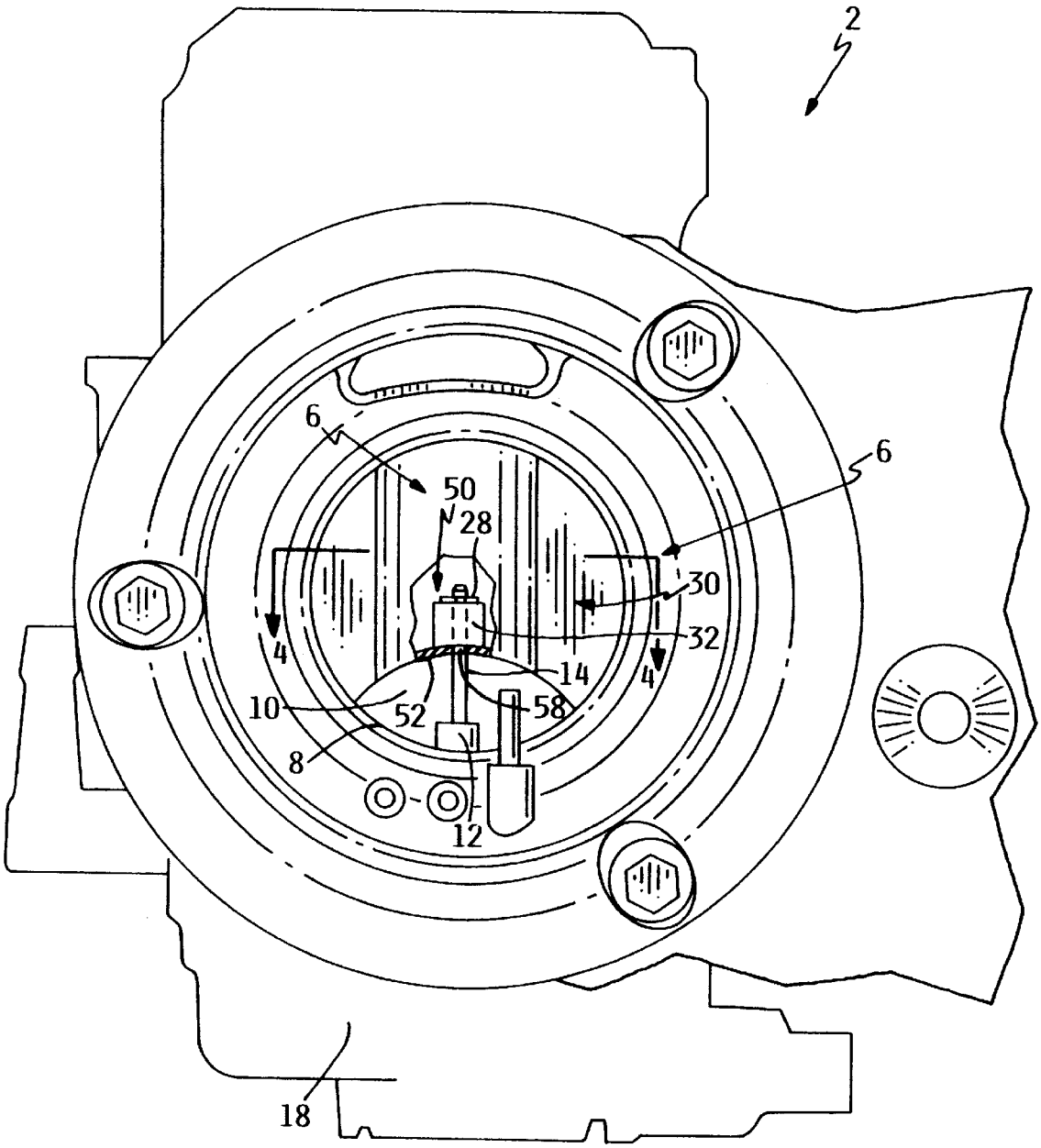
FIG. 1 is a front elevational view of a carburetor showing the air flow passage of the carburetor from the inlet end of the air flow passage, and more particularly illustrating the main fuel jet, the needle received therein, and the slide for vertically moving the needle up and down, a portion of FIG. 1 being broken away to show the attachment of the upper end of the needle to the slide and to show the vent hole in a typical carburetor, the adjustable valve of this invention not being shown in FIG. 1 for the purpose of clarity.

Referring first to FIG. 1, a carburetor 2 for use with an internal combustion engine is depicted looking in through the mouth or inlet of carburetor 2 along the air flow passage 6 formed in carburetor 2. Air flow passage 6 has a section of reduced or narrowed diameter with tapered portions on either side thereof forming a venturi 8. The far end of carburetor 2 as seen in FIG. 1 includes a pivotal throttle plate 10 also often known as a butterfly valve. Only the lower portion of throttle plate 10 can be seen in FIG. 1.

The basic purpose of carburetor 2 is to mix air and fuel together in air flow passage 6 to create a combustible air/fuel mixture. This air/fuel mixture flows through air flow passage 6 and is admitted into the intake manifold of the engine whenever throttle plate 10 is at least partially open. To accomplish the admission of fuel into air flow passage 6, one or more fuel jets may be provided for squirting or flowing fuel into the passage. Such jets are often located in venturi 8 of air flow passage 6 so that the vacuum created in venturi 8 by the air flowing therethrough will cause fuel to flow up through the fuel jets and into the passage. A main fuel jet 12 has a reciprocal flow controlling needle 14 received therein.

Main fuel jet 12 projects upwardly into the bottom of venturi 8 of air flow passage 6. Main fuel jet 12 includes an elongated, generally vertical, fuel flow passage 16 that extends downwardly into the body of carburetor 2. The lower end of fuel flow passage 16 is operatively connected to a source of fuel, such as the fuel contained in a float bowl 18 in the bottom of carburetor 2. As air passes through venturi 8, fuel will be drawn upwardly from the source thereof, through fuel flow passage 16 and through main fuel jet 12 to exit or be dispersed into air flow passage 6. Main fuel jet 12 includes a top surface 20 that is located slightly above the surface of air flow passage 6.

A flow controlling needle 14 having a tapered flow controlling section 22 is reciprocally received within main fuel jet 12. Needle 14 can be provided with a stepped portion 40 as described in the Applicant's prior U.S. Pat. No. 5,662,836, which is hereby incorporated by reference. However, stepped portion 40 could be deleted from needle 14. In any event, needle 14 has a substantially cylindrical upper end 24.

Needle 14 extends downwardly from a reciprocal slide 30 that is contained in carburetor 2. A clip 28 is located in a groove on the upper end of needle 14. Clip 28 rests on an internal boss or abutment 32 within slide 30. See FIG. 1. When so assembled, needle 14 moves vertically up and down with slide 30. As slide 30 rises, abutment 32 pushes up on clip 28 carrying needle 14 along with it. As slide 30 falls, abutment 32 falls away from clip 28 and gravity, along with a spring force if need be, causes needle 14 to fall back down with slide 30. Carburetors having a needle 14 mounted in a reciprocal slide 30, with needle 14 controlling flow through a main fuel jet 12, are well known in the art.

Figure 2:
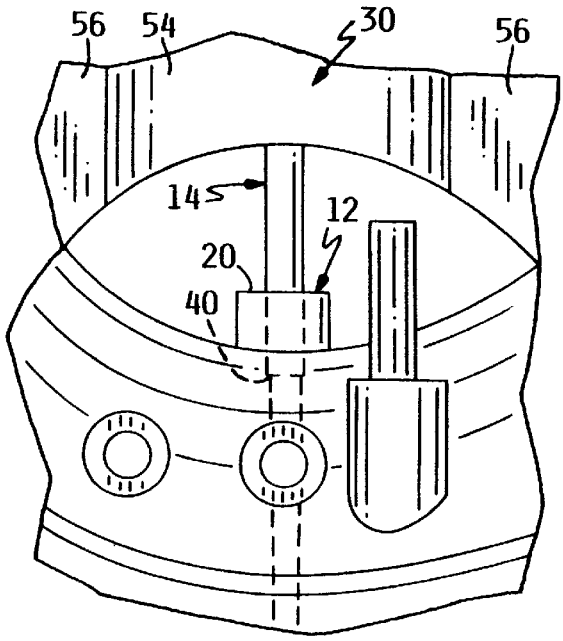
FIG. 2 is an enlarged front elevational view of the carburetor shown in FIG. 1, more particularly illustrating the flow controlling needle received within the fuel jet in its minimum fuel flow position corresponding to a minimum fuel flow condition.
Figure 3:
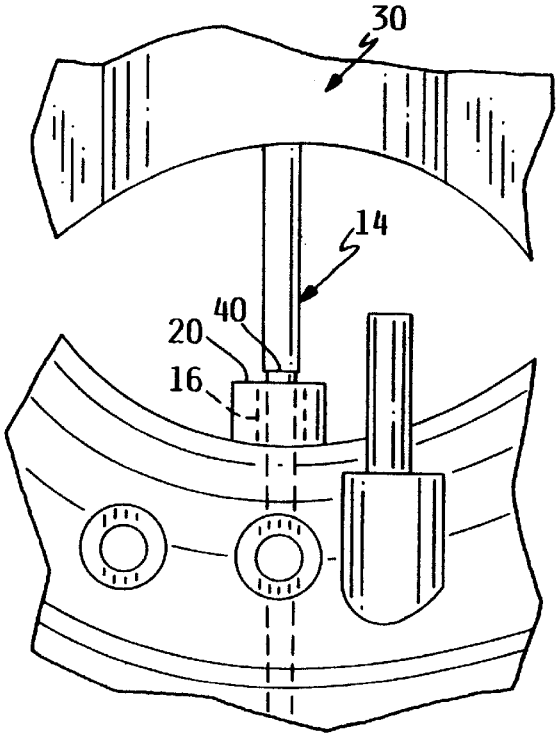
FIG. 3 is an enlarged front elevational view similar to that of FIG. 2, but showing the flow controlling needle raised by the slide to a higher position in which fuel is allowed to flow out of the main fuel jet around the needle.
Figure 4:
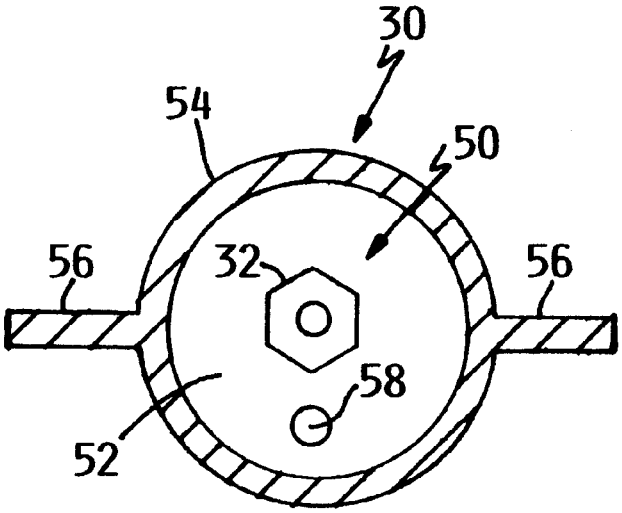
FIG. 4 is a partial cross-sectional view of FIG. 1, taken along the lines 4—4 in FIG. 1, with the adjustable valve of this invention again not being shown in FIG. 4 for the purpose of clarity.
Figure 5:
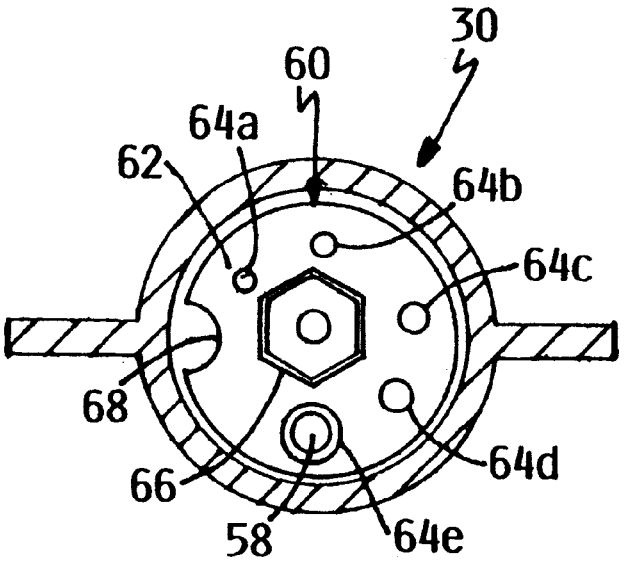
FIG. 5 is a partial cross-sectional view of FIG. 1 similar to FIG. 4, taken along the lines 4—4 in FIG. 1, but with FIG. 5 illustrating the adjustable valve of this invention overlying the vent hole in the slide of the carburetor.

In any event, main fuel jet 12 will have a minimum flow condition, which is usually a condition of zero or a very small fuel flow, when slide 30 is in its lowest position which will be referred to herein as the minimum fuel flow position of needle 14. In this minimum fuel flow position, needle 14 will extend into main fuel jet 12 a maximum amount to set the fuel flow through jet 12 to a preselected minimum value. See FIG. 2. As slide 30 rises from its lowest position, more fuel can flow through main fuel jet 16 to increase engine speed. See FIG. 3.

Slide 30 includes a hollow, cylindrical, central chamber 50 formed by a bottom wall 52 and a cylindrical sidewall 54. Two solid wings 56 extend outwardly from opposite sides of sidewall 54. Bottom wall 52 of chamber 50 may be slightly convexly curved when looking down from above bottom wall 52. A vent hole 58 is located in bottom wall 52 to one side of abutment 32 that mounts flow controlling needle 14. Vent hole 58 communicates the interior of chamber 50 with the area of air flow passage 6 that is immediately beneath slide 30.

This invention relates to the placement of a movable valve 60 on slide 30 to be able to control or adjust the size of vent hole 58. The Applicant has discovered that varying the size of vent hole 58 has an affect on the rate of rise and fall of slide 30 for identical vacuum conditions and, thus, affects the operation of the engine. Accordingly, the user can select whatever size of vent hole 58 is desired for achieving a particular set of engine operational characteristics, i.e. power vs. fuel economy.

Valve 60 is formed, in a preferred embodiment, by a rotatable valve plate 62 having a plurality of differently sized valve openings 64*a*–64*e* arranged in a circular array around the periphery of valve plate 62. Valve plate 62 is sized to fit within circular chamber 50 of slide 30 with valve plate 62 being arranged to overlie bottom wall 52 of chamber 50. Since bottom wall 52 is slightly convex when viewed from above, valve plate 62 will be similarly slightly convex to mate closely against bottom wall 52. Valve plate 62 has a central aperture 66 which is received around the outside of abutment 32.

Abutment 32 is preferably provided with a non-circular cross-sectional shape, such as a hex head shape. Central aperture 66 of valve plate 62 is provided with a similar shape. This allows valve plate 62 to be indexed into different adjusted positions where different ones of the valve openings 64 are aligned with vent hole 58. Thus, the size of vent hole 58 is controlled by which one of the valve openings 64 are aligned with vent hole 58. Obviously, valve openings 64 range in diameter from a largest one which is the same size as or slightly larger than vent hole 58 downwardly through a series of diameters that are progressively smaller than vent hole 58. Thus, the effective size of vent hole 58 is actually controlled by the size of the valve opening 64 that is above it.

In using valve plate 62, slide 30 must be removed from carburetor 2 to gain access to the interior of chamber 50 of slide 30. When slide 30 is so removed, chamber 50 is open from above. The user can then reach down into chamber 50 and, with his fingers or with a tool, pry valve plate 62 up off of abutment 32. Valve plate 62 is provided with a cutout 68 on the periphery thereof to allow access to the edge of valve plate 62 to allow this prying action to occur.

After valve plate 62 has been lifted up off of abutment 32, it can then be manually rotated to a different indexed position where the hex head aperture 66 in valve plate 62 has been realigned with hex head abutment 32. Valve plate 62 can then be dropped or pushed back down onto abutment 32 in this new position. The effect of this adjustment procedure, i.e. lifting valve plate 62 up off of abutment 32, rotating valve plate 62 to a different position, and then dropping valve plate 62 back down onto abutment 32, is to remove a valve opening 64 having a particular diameter from its overlying position on top of vent hole 58 and replace that valve opening 64 with another valve opening 64 having a different diameter. This is the adjustment procedure for changing or adjusting the size of vent hole 58.

Various modifications of this invention will be apparent to those skilled in the art. For example, valve plate 62 has been shown as being manually rotatable only after it is first disengaged from abutment 32 by being lifted up off of abutment 32. However, a valve plate 62 could be used that is rotatable around a smooth cylindrical abutment 32. Rotation of such a valve plate 62 could occur without lifting valve plate 62 up off of abutment 32. Some type of detent between valve plate 62 and chamber 50 would be used in this structure to provide the indexing required in valve plate 62, i.e. to ensure that valve openings 64 align with vent hole 58 in the different adjusted positions of valve plate 62. In this case, the tool inserted into cutout 68 would simply be used to rotate valve plate 62 in one direction or the other.

Another variation on this latter described valve plate would be to use some type of rotatable adjustment shaft in slide 30 for rotating valve plate 62. Such a shaft would have an inner end connected in some way to valve plate 62 for rotating valve plate 62 when the shaft rotates, e.g. by using a worm gear connection between the shaft and the edge of valve plate 62. The outer end of the shaft would lead to an exterior surface of slide 30. Thus, the user could rotate valve plate 62 by inserting a tool into the outer end of the shaft and rotating the shaft. The use of such an additional adjustment shaft would avoid having to disassemble slide 30 from carburetor 2 to adjust the size of vent hole 58, but obviously entails using an additional part, i.e. the shaft itself and the connection to valve plate 62, in the fairly small space of chamber 50.

Accordingly, the scope of the present invention is to be limited only by the appended claims.

I claim:

1. An air/fuel mixing device, which comprises:

(a) a fuel jet for supplying fuel to an air flow passage, wherein the fuel jet has a fuel flow passage that is operatively connected to the air flow passage for conducting fuel from a supply of fuel through the fuel jet and into the air flow passage;

(b) a flow controlling needle reciprocally mounted by a slide in the fuel flow passage of the fuel jet to control the amount of fuel that flows therein;

(c) a vent hole on the slide; and (d) a valve movably carried on the slide to adjust the size of the vent hole, wherein the valve is rotatable carried on the slide, wherein the valve comprises a valve plate that overlies the vent hole, wherein the valve plate has a series of valve openings of different size, wherein one valve opening may be placed over the vent hole at a time such that the size of the vent hole is determined by the size of the valve opening placed over the vent hole, and wherein the size of the valve opening is adjusted by changing which valve opening is placed over the vent hole, wherein the valve plate is indexed relative to the vent hole to align the valve openings relative to the vent hole, and wherein the slide includes an abutment having a non-circular configuration, and wherein the valve plate has a mating non-circular opening which can be received over the non-circular abutment to provide a plurality of indexed positions for the valve plate.

2. The air/fuel mixing device of claim 1, wherein the valve plate is substantially circular and is located inside of a hollow, cylindrical chamber in the slide.

3. A slide carburetor, which comprises:

(a) a reciprocal slide that moves up and down in an air flow passage, movement of the slide controlling the amount of fuel supplied to the air flow passage for mixing with air; and (b) a vent hole on the slide having an adjustable size that is manually and selectively adjustable by a user with the size of the vent hole once adjusted by the user being fixed and independent of the movement of the slide during operation of the carburetor, to thereby allow the user to manually select a particular size of the vent hole to adjust the rate of movement of the slide, wherein the adjustable size of the vent hole is provided by a movable valve carried on the slide which is in operative connection with the vent hole, wherein the valve comprises a rotatable valve plate closely adjacent to and overlying the vent hole, and wherein the valve plate has a series of valve openings of different size that can be selectively aligned with the vent hole to control the size of the vent hole.

4. A slide carburetor as recited in claim 3, wherein the slide includes a hollow chamber, and the vent hole communicates the hollow chamber with the air flow passage.

5. A slide carburetor as recited in claim 4, wherein the hollow chamber is formed by a bottom wall and a cylindrical sidewall, and wherein the vent hole is in the bottom wall of the chamber.

6. A slide carburetor as recited in claim 5, wherein the valve is carried inside the hollow chamber above the bottom wall thereof.

7. An air/fuel mixing device, which comprises:

(a) a fuel jet for supplying fuel to an air flow passage, wherein the fuel jet has a fuel flow passage that is operatively connected to the air flow passage for conducting fuel from a supply of fuel through the fuel jet and into the air flow passage;

(b) a flow controlling needle reciprocally mounted by a slide in the fuel flow passage of the fuel jet to control the amount of fuel that flows therein;

(c) a vent hole on the slide; and (d) a valve movably carried on the slide to adjust the size of the vent hole, wherein the valve is rotatably carried on the slide, wherein the valve comprises a valve plate that overlies the vent hole, wherein the valve plate has a series of valve openings of different size, wherein one valve opening may be placed over the vent hole at a time such that the size of the vent hole is determined by the size of the valve opening placed over the vent hole, and wherein the size of the valve opening is adjusted by changing which valve opening is placed over the vent hole, wherein the valve plate is indexed relative to the vent hole to align the valve openings relative to the vent hole, wherein the valve plate includes a portion thereof adapted to provide access to the valve plate for manipulation of the valve plate, wherein the valve plate portion that provides access comprises a cutout along a peripheral edge of the valve plate.

* * * * *